US006766738B2

(12) United States Patent
Blümm et al.

(10) Patent No.: US 6,766,738 B2
(45) Date of Patent: Jul. 27, 2004

(54) CYLINDER JACKET PROFILE, METHOD OF PRODUCING AN EASY-CLEAN LAYER ON A CYLINDER JACKET PROFILE AND PRINTING PRESS

(75) Inventors: Monika Blümm, Wiesloch (DE); Jörg Oliver Kain, Weiterstadt (DE); Marina Kraft, Walldorf (DE)

(73) Assignee: Heidelberger Drukmaschinen AG, Heidelberg (DE)

( * ) Notice: Subject to any disclaimer, the term of this patent is extended or adjusted under 35 U.S.C. 154(b) by 21 days.

(21) Appl. No.: 10/022,660

(22) Filed: Dec. 18, 2001

(65) Prior Publication Data

US 2002/0073860 A1 Jun. 20, 2002

(30) Foreign Application Priority Data

Dec. 18, 2000 (DE) ..... 100 63 171

(51) Int. Cl.[7] ..... B41F 13/24; B65H 3/30; B22F 5/00

(52) U.S. Cl. ..... 101/232; 101/420; 101/422; 271/22; 492/18; 492/30; 492/52; 428/600; 428/606; 428/667

(58) Field of Search ..... 101/232, 420, 101/422; 271/22; 492/18, 30, 52; 428/600, 606, 667

(56) References Cited

U.S. PATENT DOCUMENTS

| | | | | | |
|---|---|---|---|---|---|
| 3,630,802 | A | * | 12/1971 | Dettling | 156/231 |
| 3,791,644 | A | | 2/1974 | DeMoore | |
| 4,327,135 | A | * | 4/1982 | Wirz | 428/600 |
| 5,042,383 | A | * | 8/1991 | Wirz | 101/420 |
| 5,127,325 | A | * | 7/1992 | Fadner | 101/348 |
| 5,343,807 | A | | 9/1994 | Hackelborger et al. | |
| 5,495,801 | A | * | 3/1996 | Dankert | 101/148 |
| 5,797,827 | A | | 8/1998 | Sondergeld | |
| 6,041,706 | A | * | 3/2000 | Murray | 101/217 |
| 6,077,207 | A | | 6/2000 | Yokoyama et al. | |

FOREIGN PATENT DOCUMENTS

| | | |
|---|---|---|
| DE | 2 227 485 | 1/1973 |
| DE | 29 14 255 | 11/1979 |
| DE | 39 31 479 A1 | 4/1991 |
| DE | 42 07 119 C2 | 9/1993 |
| DE | 195 15 393 A1 | 10/1996 |
| DE | 199 14 136 A1 | 9/2000 |
| EP | 0 654 494 A1 | 5/1995 |
| GB | 1 390 833 | 4/1975 |
| GB | 2 022 016 A | 12/1979 |
| GB | 2 236 508 A | 4/1991 |
| WO | WO 96/04123 | 2/1996 |
| WO | WO 96/32264 | 10/1996 |

* cited by examiner

*Primary Examiner*—Andrew H. Hirshfeld
*Assistant Examiner*—Marvin P. Crenshaw
(74) *Attorney, Agent, or Firm*—Laurence A. Greenberg; Werner H. Stemer; Ralph E. Locher

(57) ABSTRACT

A cylinder jacket profile for impression cylinders or sheet transfer cylinders has uniformly distributed elevations with an easy-clean layer as a surface coating. The easy-clean layer has a thickness of less than 5 $\mu$m, in particular 1 $\mu$m, and a surface energy of less than 50 mN/m. The cylinder jacket profile has an improved cleaning behavior. A method of producing an easy-clean layer on a cylinder jacket profile is also provided.

10 Claims, 2 Drawing Sheets

CYLINDER JACKET PROFILE, METHOD OF PRODUCING AN EASY-CLEAN LAYER ON A CYLINDER JACKET PROFILE AND PRINTING PRESS

BACKGROUND OF THE INVENTION

1. Field of the Invention

The invention relates to a cylinder jacket profile, a method of producing a cylinder jacket profile, and to a rotary printing press.

German Patent No. DE 42 07 119 C2 discloses a conventional cylinder jacket profile. An impression cylinder or sheet guiding cylinder includes a surface coating which is polished parallel to the axis of the impression cylinder. The cylinder jacket profile is formed from cylindrical elevations which are disposed perpendicular to the surface of the cylinder jacket. The cylindrical elevations have a cylinder length of 20 to 200 $\mu$m, and the raster definition is 400 to 10,000 points/cm$^2$. The impression cylinder has a chromium surface coating into which the cylinder jacket profile is etched. The cylinder jacket profile is formed of individual, statistically uniformly distributed elevations. The high surface energy of chromium of 78 mN/m is disadvantageous due to the associated contamination problems, namely the smearing of the freshly printed surface, as well as the expensive production technique.

Furthermore, it is generally known that the cleanability of impression cylinders may be improved by applying a nonstick coating, for instance a TEFLON or silicon coating, with a typical thickness of some 20 $\mu$m. The large alteration of the surface structure of the impression cylinder as a result of the layer and the associated increased degradation of the print result are disadvantageous. Furthermore, the wear resistance of these nonstick layers and their chemical resistance to the cleaning and printing chemicals are low. In addition, this type of coated impression cylinder often cannot sufficiently hold the sheet in the printing process.

Various techniques are generally known for nonstick coatings with a low surface energy. For instance, amorphous, adamantine carbon layers are deposited in thicknesses of 1 to 10 $\mu$m using CVD (Chemical Vapor Deposition) or PVD (Physical Vapor Deposition) methods. This way, wear-resistant nonstick layers with low surface energy or surface tension (typically 20–40 mN/m) can be realized for refining or finishing surfaces, for instance of tools.

Colloid technology is a new technology for coating surfaces with a nonstick coating in thicknesses of 100 nm to 10 $\mu$m.

This technology takes advantage of the complex formation of a polyelectrolyte with fluorine surfactants. The externally exposed surfactant layer, which itself is only up to 1 nm thick, is distinguished by extreme smoothness and extremely low surface tension (11–16 mN/m).

With inorganic-organic hybrid polymers, by incorporating functional groups of, for instance, perfluorinated silane compounds in the silicate frame, it is possible to generate layers with nonstick properties which are not only water-repellent (hydrophobic) but also oil- and grease-repellent (oleophobic) and which therefore have an improved protective effect. The achieved surface characteristics effectuate a reduced adhesion of dirt particles and thus a good cleaning behavior.

In a sol-gel process, it is possible to produce a coating, for instance by immersion or spraying, as an easy-clean layer on the basis of inorganic-organic nanocomposites with a low free surface energy (approx. 19 mN/m) and a high resistance to scratching and rubbing owing to fluorinated organic groups.

It is also known how to realize surfaces having periodic structures with dimensions in the range between 1 $\mu$m and 100 nm by photolithography techniques.

Particularly good cleaning characteristics of surfaces can also be realized using a system of plasma-polymer thin layers.

Further, the so-called lotus effect for self-cleaning surfaces is known. In particular, a self-cleaning surface including an artificial surface structure of elevations and depressions is described in European Patent No. EP 0 772 524 B1. The spacing between the elevations is in the range between 5 and 200 $\mu$m, and at least the elevations are formed of hydrophobic polymers or durable hydrophobized materials. The elevations cannot be removed by water or water in combination with detergents.

SUMMARY OF THE INVENTION

It is accordingly an object of the invention to provide a cylinder jacket profile which overcomes the above-mentioned disadvantages of the heretofore-known profiles of this general type and which ameliorates the presently existing problems when guiding a sheet in a recto/verso printing operation, and which particularly improves the cleaning behavior of a cylinder jacket profile.

With the foregoing and other objects in view there is provided, in accordance with the invention, a cylinder jacket profile configuration for a rotary printing press cylinder, including:

a sheet-guiding cylinder jacket profile having elevations; and an easy-clean layer as a surface coating for the sheet-guiding cylinder jacket profile, the easy-clean layer having a thickness of less than 5 $\mu$m, in particular approximately 1 $\mu$m, and a surface energy of less than 50 mN/m.

According to the invention, the cylinder surface is provided with a surface structure. It is of no importance whether the structure is created on the surface of the cylinder itself or on a layer or covering that is applied to the cylinder. In particular, the cylinder can be constructed with a structured surface by spray techniques, jet techniques or molding techniques. In addition, a coating with a thin and low-energy layer which is easy to clean is provided on the surface in such a way that the dimensions of the surface structure remain substantially unaffected.

According to another feature of the invention, the sheet-guiding cylinder jacket profile includes an anti-wear layer, the easy-clean layer is disposed on the anti-wear layer, for example a chromium layer.

It can be advantageously provided that the layer which is constructed for easy cleaning be applied to a structured chromium layer. Because of the small thickness, the layer can be worn off in the contact region in the elevations after only a few revolutions of the impression cylinder, such that the easy-clean layer is interrupted on the elevations. The chromium layer then takes over the generation of high counterpressure, while the ink barely sticks in the depressions of the jacket profile or is easily removed therefrom due to the easy-clean layer.

According to a preferred embodiment, the cylinder jacket profile is constructed with spherical elevations and/or depressions. This makes it possible to realize a good cleanability of the surface, whereby a sufficiently high counterpressure can also be achieved in the print operation. Besides this, a surface so constructed without corners or slopes can be evenly coated with ease. Alternatively, however, it is possible to provide elevations on the surface in the shape of pyramids, cylinders, spheres, truncated cones and/or in an irregularly structured fashion. In accordance with the invention, the various structural shapes may also be combined.

The structured surface according to the invention allows to guide the sheet without slippage or scratching, while experiencing only slight wear. The low-energy coating which is applied to the anti-wear chromium coating serves for picking up optimally little or no ink in the regions in which the sheet has no direct contact with the cylinder jacket profile.

When the easy-clean layer is not sufficiently wear-resistant, it is worn off during use in the regions of contact with the sheet. But this is not problematic, since the low-energy easy-clean layer is preferably intended to exert its effect only between the contact points of the sheet.

With the objects of the invention in view there is also provided, a method for producing an easy-clean layer on a cylinder jacket profile, the method includes the steps of:

providing a cylinder jacket profile having elevations; and applying an easy-clean layer as a surface coating for the cylinder jacket profile such that the easy-clean layer has a thickness of less than 5 $\mu$m and a surface energy of less than 50 mN/m.

According to another mode of the invention, the easy-clean layer is initially applied as a substantially uninterrupted layer and subsequently removed from the elevations, preferably by contacting the easy-clean layer with a printing sheet during a printing operation.

With the objects of the invention in view there is also provided, a printing press, including:

a cylinder having a jacket surface with a cylinder jacket profile having elevations; and an easy-clean layer provided as a surface coating for the cylinder jacket profile, the easy-clean layer having a thickness of less than 5 $\mu$m and a surface energy of less than mN/m.

According to another feature of the invention, the cylinder is a sheet-guiding cylinder such as an impression cylinder or a sheet transfer cylinder used for a recto/verso printing.

Other features which are considered as characteristic for the invention are set forth in the appended claims.

Although the invention is illustrated and described herein as embodied in a cylinder jacket profile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
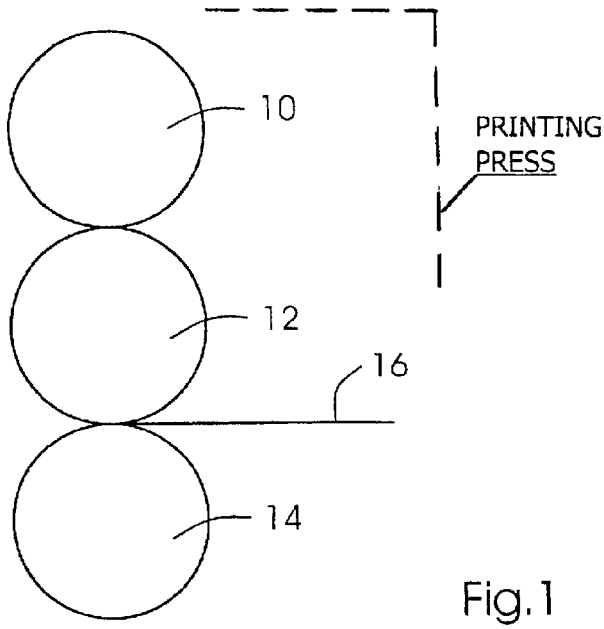
FIG. 1 is a simplified diagrammatic view of a printing configuration.
Figure 2A:
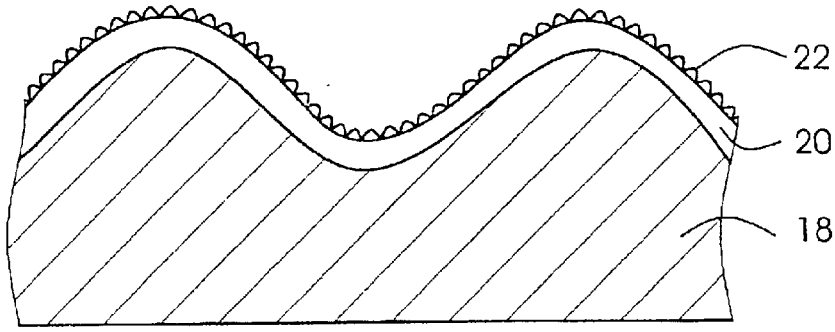
FIG. 2*a* is an enlarged, partial sectional diagrammatic view of the cylinder jacket profile according to the invention prior to being put into operation.

Referring now to the figures of the drawings in detail and first, particularly, to FIG. 1 thereof, there is shown a plate cylinder 10 which is provided in an offset printing press which is only schematically indicted with a dashed line. A printing plate which includes the information that is to be printed is clamped onto the plate cylinder 10. Following the application of ink onto the plate cylinder 10, the regions that are to be printed are transferred to a rubber blanket cylinder 12. A sheet or paper web 16 is led into the nip between the rubber blanket cylinder 12 and what is known as an impression cylinder 14. The profile of the impression cylinder surface 14 has a multi-layered structure (FIG. 2*a*). First a nickel layer 18 with a spherical surface structure is provided as base layer, which is covered by a thin chromium layer 20 in turn. Alternatively, the nickel layer 18 can also be realized with a planar surface, whereby only the chromium layer 20 is applied in a spherical shape with uniformly distributed elevations and depressions. Typical spacings between the elevations are between 20 and 100 $\mu$m; typical thicknesses of the chromium layer are between 5 and 10 $\mu$m. The chromium spherical structure 20 is covered by a roughened microstructure as easy-clean layer 22, the thickness of which is preferably between 10 nm and 2 $\mu$m, the microstructure exhibiting a lotus effect, which is known per se and which results in a known self-cleaning effect. This layer 22 can be produced as an amorphous carbon layer by the colloid technique or as a sol-gel lacquer. It is likewise possible to generate the layer by deposition from the gas phase, for instance by plasma polymerization, plasma supported chemical deposition from the gas phase (PECVD, Plasma-Enhanced Chemical Vapor Deposition) or similar techniques.

Alternatively, the easy-clean layer 22 can also be constructed as a completely smooth microstructure with a free surface energy between 10 and 50 mN/m. The thickness of the easy-clean layer 22 is selected small enough that it does not adversely alter or distort the surface profile of the chromium layer 20, which is optimized in accordance with the respective demands on the impression cylinder 14. The microstructure 22 need not necessarily be provided at the elevations of the sphere structure 22, since an impression surface which is smooth in itself is desired at these points. It is sufficient when the microstructure, i.e. the easy-clean layer 22, is provided only in the depressions of the cylinder jacket profile, where it exerts its self-cleaning effect.

However, it would be very expensive in terms of application technology to introduce the easy-clean layer 22 only in the depressed regions. For this reason, the easy-clean layer 22 is applied to the spherical chromium structure 20 surface-wide, i.e. as an uninterrupted layer (FIG. 2*a*), and eroded or removed by the mechanical contact with the sheet 16 after only a few revolutions of the impression cylinder 14 (FIG. 2*b*) simply in the course of its use. The surface structure of the jacket profile is altered, if at all, to such a small extent that adverse effects do not arise in the subsequent print operation.

Figure 2B:
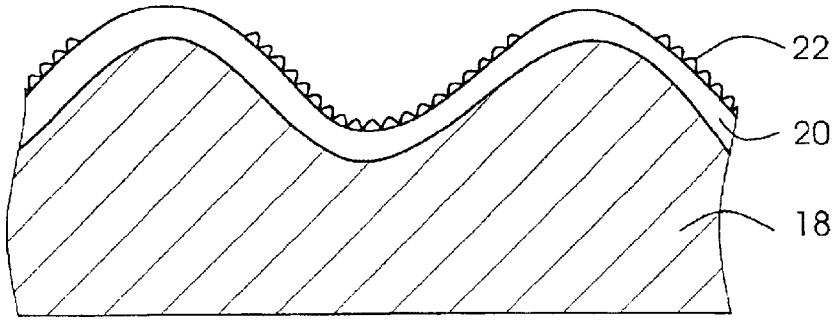
FIG. 2*b* is an enlarged, partial sectional diagrammatic view of the cylinder jacket profile according to the invention after several revolutions of the impression cylinder in the print operation.

As a result, after only a few revolutions of the impression cylinder 14, the available impression cylinder surface includes a spherical structure with the additional easy-clean microstructure 22. The spherical structure guarantees that ink particles which are inadvertently or undesirably applied to the impression cylinder 14 can run into the depressions of the spherical structure 20, and accordingly, they are not transferred onto the sheet 16 when the counterpressure is exerted on it, since only the elevations of the chromium sphere structure 20 press against the sheet. The surface shape of the spherical structure guarantees that the ink is optimally repelled due to the easy-clean layer 22 and thereby prevented from adhering to the impression cylinder 14, and at the same time a sufficiently high counterpressure is made available by the wear-free chromium surface 20 (FIG. 2*b*).

Figure 3:
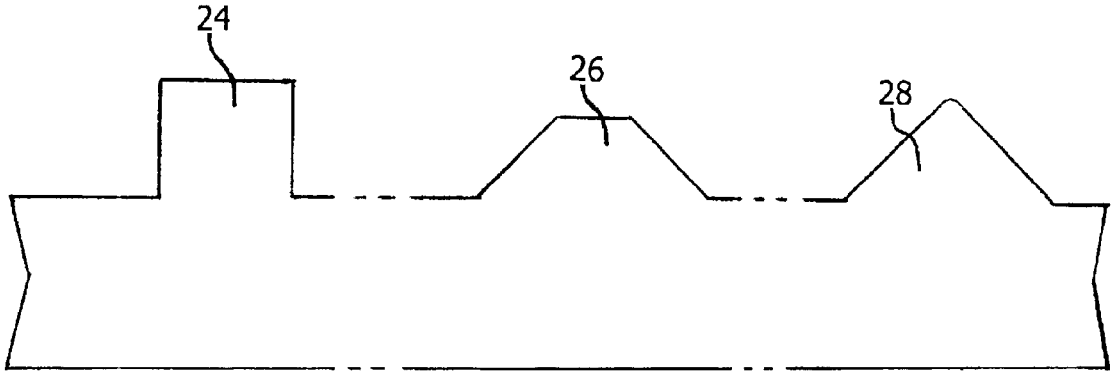
FIG. 3 is a partial sectional, highly diagrammatic view of a cylinder jacket profile for illustrating various surface structure configurations.

FIG. 3 is a partial sectional, highly diagrammatic view of a cylinder jacket profile for illustrating various surface structure configurations, such as a cylindrical shape 24, a conical shape, for example a truncated cone 26 or a pyramidal shape 28.

The invention has been described in connection with an impression cylinder. But clearly it can also be used in other paper guiding or sheet transferring cylinders.

We claim:

1. A cylinder jacket profile configuration for a rotary printing press cylinder, comprising:

a sheet-guiding cylinder jacket profile including a spherical surface structure having elevations;

an easy-clean microstructure layer as a surface coating for said sheet-guiding cylinder jacket profile, said easy-clean microstructure layer being interrupted on said elevations, and said easy-clean microstructure layer having a thickness of less than 5 $\mu$m and a surface energy of less than 50 mN/m.

2. The cylinder jacket profile configuration according to claim 1, wherein said thickness of said easy-clean microstructure layer is substantially 1 $\mu$m.

3. The cylinder jacket profile configuration according to claim 1, wherein said sheet-guiding cylinder jacket profile includes an anti-wear layer, said easy-clean microstructure layer is disposed on said anti-wear layer.

4. The cylinder jacket profile configuration according to claim 3, wherein said anti-wear layer is a chromium layer.

5. The cylinder jacket profile configuration according to claim 1, wherein said easy-clean microstructure layer exhibits a lotus effect.

6. A printing press, comprising:

a cylinder having a jacket surface with a cylinder jacket profile including a spherical surface structure having depressions; and an easy-clean microstructure layer being provided as a surface coating for said cylinder jacket profile, said easy-clean microstructure layer being provided only in said depressions, and said easy-clean microstructure layer having a thickness of less than 5 $\mu$m and a surface energy of less than 50 mN/m.

7. The printing press according to claim 6, wherein said cylinder is a sheet-guiding cylinder selected from the group consisting of an impression cylinder and a sheet transfer cylinder configured for a recto/verso printing.

8. A method for producing an easy-clean layer on a cylinder jacket profile, the method which comprises:

providing a cylinder jacket profile having a spherical surface structure;

applying an easy-clean layer as a surface coating for the cylinder jacket profile, the easy-clean layer providing a microstructure to the jacket profile such that the easy-clean layer has a thickness of less than 5 $\mu$m and a surface energy of less than 50 mN/m; and applying the easy-clean layer initially as a substantially uninterrupted layer and subsequently removing the easy-clean layer from elevations of the spherical surface structure.

9. The method according to claim 8, which comprises applying the easy-clean layer such that the thickness of the easy-clean layer is substantially 1 $\mu$m.

10. The method according to claim 8, which comprises removing the easy-clean layer by contacting the easy-clean layer with a printing sheet during a printing operation.

* * * * *